US005933892A

United States Patent [19]

Tramontano

[11] Patent Number: 5,933,892

[45] Date of Patent: Aug. 10, 1999

[54] MULTIPURPOSE BOTTLE CAP LAUNCHER

[76] Inventor: Steve Tramontano, 102 Flaxwood Dr., Holbrook LI, N.Y. 11741

[21] Appl. No.: 09/073,897

[22] Filed: May 6, 1998

[51] Int. Cl.[6] ..... B25F 1/00

[52] U.S. Cl. ..... 7/151; 124/26; 124/42; 273/317

[58] Field of Search ..... 7/151, 167, 170; 124/26, 42, 37; 273/317

[56] References Cited

U.S. PATENT DOCUMENTS

| | | | |
|---|---|---|---|
| 2,621,550 | 12/1952 | Bach | 7/151 |
| 4,016,854 | 4/1977 | Lehman . | |
| 4,412,464 | 11/1983 | Cook | 7/151 X |
| 4,455,894 | 6/1984 | Roberts . | |
| 4,846,024 | 7/1989 | Bryant et al. . | |
| 5,282,634 | 2/1994 | Chamberland . | |
| 5,537,985 | 7/1996 | Kohl . | |
| 5,621,936 | 4/1997 | Penaligon . | |

*Primary Examiner*—James G. Smith
*Attorney, Agent, or Firm*—Michael I. Kroll

[57] ABSTRACT

A multipurpose bottle cap launcher (14) comprising a body member (16). An assembly (18) in the body member (16) is for shooting a bottle cap (20) therefrom for recreational target practice. A structure (22) in the body member (16) is for removing a bottle cap (20) from a bottle (24), which can be held and manipulated by a hand (26) of a person (28). A facility (30) in the body member (16) is for holding at least one key (32) thereon, to prevent loss of the at least one key (32), so that it can be used by the person (28) to unlock locks.

21 Claims, 8 Drawing Sheets

MULTIPURPOSE BOTTLE CAP LAUNCHER

BACKGROUND OF THE INVENTION

1. Field of the Invention

The instant invention relates generally to hand held propelling and opening devices and more specifically it relates to a multipurpose bottle cap launcher. The multipurpose bottle cap launcher will allow a person to shoot bottle caps therefrom for recreational target practice. The multipurpose bottle cap launcher contains a built-in bottle cap remover, which can be held and manipulated by a human hand. The multipurpose bottle cap launcher also has a key ring holder for keeping at least one key thereon, to prevent loss of the key, so that it can be used by the person for unlocking locks.

2. Description of the Prior Art

Numerous hand held propelling and opening devices have been provided in prior art. For example, U.S. Pat. No. 4,016,854 to Lehman; U.S. Pat. No. 4,455,894 to Roberts; U.S. Pat. No. 4,846,024 to Bryant et al.; U.S. Pat. No. 4,854,856 to Steiger Jr., et al.; U.S. Pat. No. 5,282,634 to Chamberland; U.S. Pat. No. 5,537,985 to Kohl and U.S. Pat. No. 5,621,936 to Penaligon et al. all are illustrative of such prior art. While these units may be suitable for the particular purpose to which they address, they would not be as suitable for the purposes of the present invention as heretofore described.

LEHMAN, JAMES A.

SPRING TYPE BOTTLE CAP PISTOL

U.S. Pat. No. 4,016,854

A pistol to propel and sign ring-like projectiles such as bottle caps. An impeller is released by a trigger and an off-center mounted hammer strikes and propels the bottle caps with a spin. As the bottle cap exits from the barrel of the gun, a wall mounted rib imparts an additional spinning force to the bottle cap. The trigger of the pistol has a portion for engaging and holding an inside surface of the peripheral wall of the projectile in the firing chamber. When the trigger is actuated, the portion engaging the projectile will pivot away and permit the spring biased plunger to engage and propel the projectile.

ROBERTS, RICHARD D.

HAND HELD OPENING APPARATUS

U.S. Pat. No. 4,455,894

A hand held opening apparatus with no moving parts which includes three distinctly different opening devices. One of the opening devices consists of a centrally located socket-like portion at the center of a substantially flat body portion. This opening device is adapted to be telescoped over twist-off bottle cap members. A second opening device is located at one end of the flat body portion and consists of a wedge member insertable beneath a ring pull tab of a can end easy opening member. The third opening device is used to open plastic bags or the like and consists of a blade laminated within upper and lower portions of the flat body portion at the end opposite the second opening device. The body portion may be made from a plastic material and a permanent magnet may be embedded in one surface of the flat body member, to permit the apparatus to be held magnetically when not in use.

BRYANT, DAVID R.

KOCHTE, WERNER W.

TROMBLY, EDWARD F.

THREE-WAY OPENER

U.S. Pat. No. 4,846,024

An opener for tab-top, screw-top and crimped top beverage contains is disclosed. The opener comprises an injection-molded, substantially flat, elongated handle of an essentially constant wall thickness having a central portion and two ends. A cavity is molded in one end of the handle. A serrate frustoconical receptacle is molded in the central portion of the handle. An opening is molded in the other end of the handle. A passage is also molded in the other end and communicates with the opening. A steel insert is frictionally retained in the passage with a portion of the insert protruding into the opening. In use, the cavity receives a tab-top tab, the receptacle engages a screw-top cap, or the opening receives a crimped-top cap, with the insert engaging the edge of the cap. The ergonomic handle is then used as a lever to open the container. A permanent magnet may be attached to the opener, to allow easy storage on a magnetic surface. The opener may be provided with holes for attaching a cord or tether.

STEIGER, JR., H. M.

CATANIA, VICTOR M.

CONTAINER OPENER AND LIGHTER COMBINATION

U.S. Pat. No. 4,854,856

A combination lighter and container opener includes an elongated handle which has a container opener member at one end. The other end of the handle has a pair of rolled under and inwardly turned flanges oriented to permit the frictional wedging engagement of the fuel tank portion of a disposable lighter, leaving the igniter portion of the lighter extending beyond the other end of the handle. The handle has a length which is greater than the length of the lighter, and the flanges are spaced apart to permit a lighter to be pushed out of the handle for replacement with a new one when the fuel is spent.

CHAMBERLAND, MARC

PINCERS FOR THROWING AND CATCHING A FLYING DISC

U.S. Pat. No. 5,282,634

The pincers have lower and upper jaws which selectively close for engaging and open for disengaging a flying disc such as a FRISBEE. The jaws are interconnected at one end and have at the opposite ends of each, a pad for gripping the central portion of the disc. A wall of the lower jaw has a depression which opens upwardly toward the inner wall of the upper jaw. The depression is defined at one side by a ramp which extends to the pad attached to the lower jaw. The other side of the depression is defined by a wall which curves to a ridge. A notch is formed on the side of the ridge opposite the depression for receipt of the rim of the disc when it is clamped between its jaws.

KOHL, WILLIAM K.

DISC LAUNCHER

U.S. Pat. No. 5,537,985

A rigid, hand-held disc launcher for launching small cardboard discs, having a handle attached to a head which is curved in a substantially semi-circular arc of approximately 180 degrees. An open-ended slot runs through the entire arc of the curved head with one slot opening in the head being located near the handle and the other slot opening being located at the other end of the head. A disc inserted in the slot opening near the handle is launched from the other slot opening, when accelerated by centrifugal forces caused by the disc launcher being swung forward by the handle.

PENALIGON, JANET L.

SMITH, JERRY L.

MULTI-PURPOSE HAND TOOL

U.S. Pat. No. 5,621,936

A utensil is adapted to be held by a user and manipulated by the user's hand to operate on a workpiece. One feature of the utensil enables the user to gain mechanical advantage when locking and unlocking key-operated locking mechanism by displacing a key from its stowed state to its extended state. Other features include a letter opener, a cap remover, and an abrasive element.

SUMMARY OF THE INVENTION

A primary object of the present invention is to provide a multipurpose bottle cap launcher that will overcome the shortcomings of the prior art devices.

Another object is to provide a multipurpose bottle cap launcher that will allow a person to shoot bottle caps therefrom for recreational target practice.

An additional object is to provide a multipurpose bottle cap launcher that contains a built-in bottle cap remover, which can be held and manipulated by a human hand, as well as a key ring holder for keeping at least one key thereon, to prevent loss of the key, so that it can be used by the person for unlocking locks.

A further object is to provide a multipurpose bottle cap launcher that is simple and easy to use.

A still further object is to provide a multipurpose bottle cap launcher that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
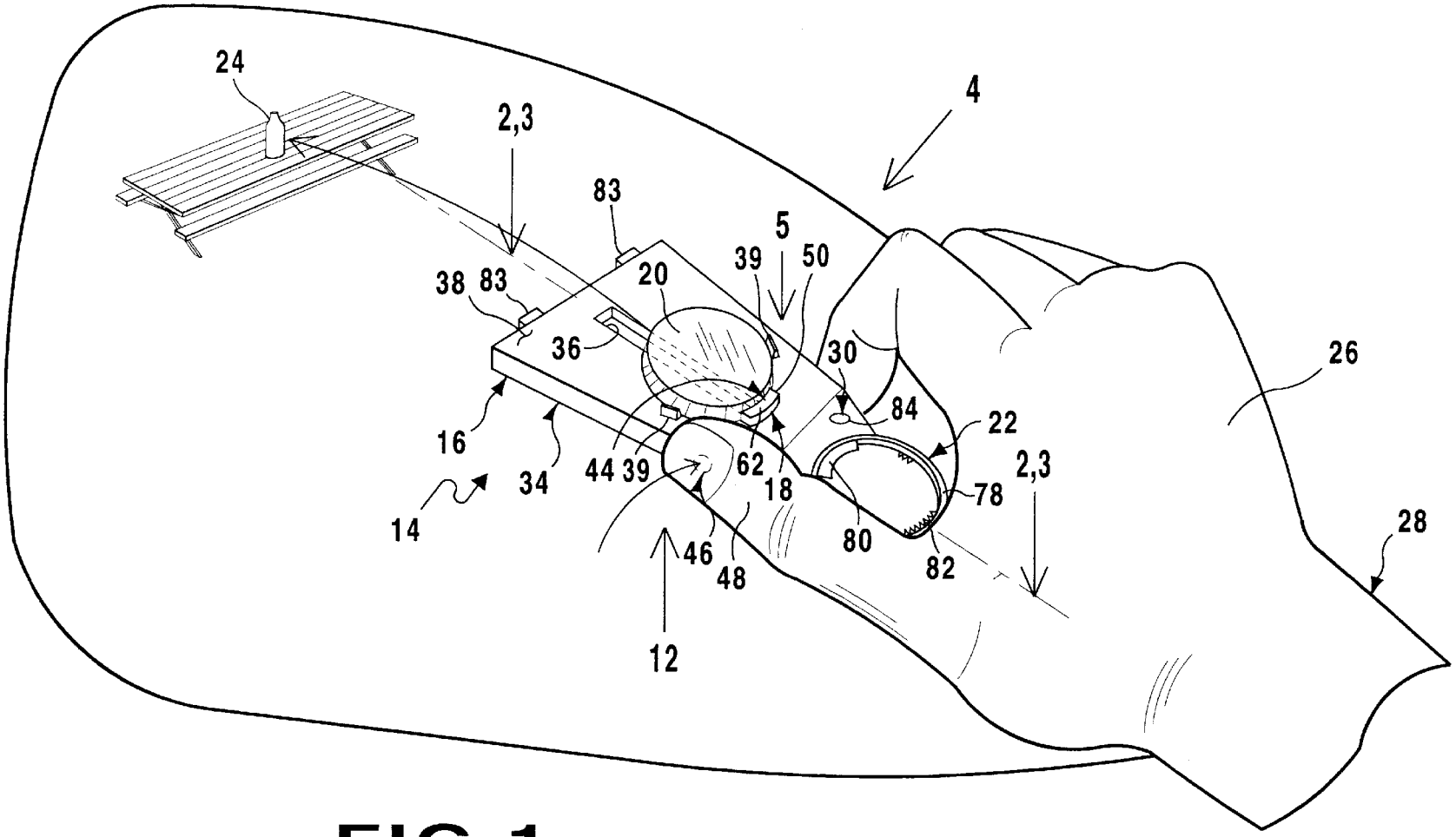
FIG. 1 is a perspective view of the present invention ready to shoot a bottle cap therefrom, for recreational target practice.
Figure 2:
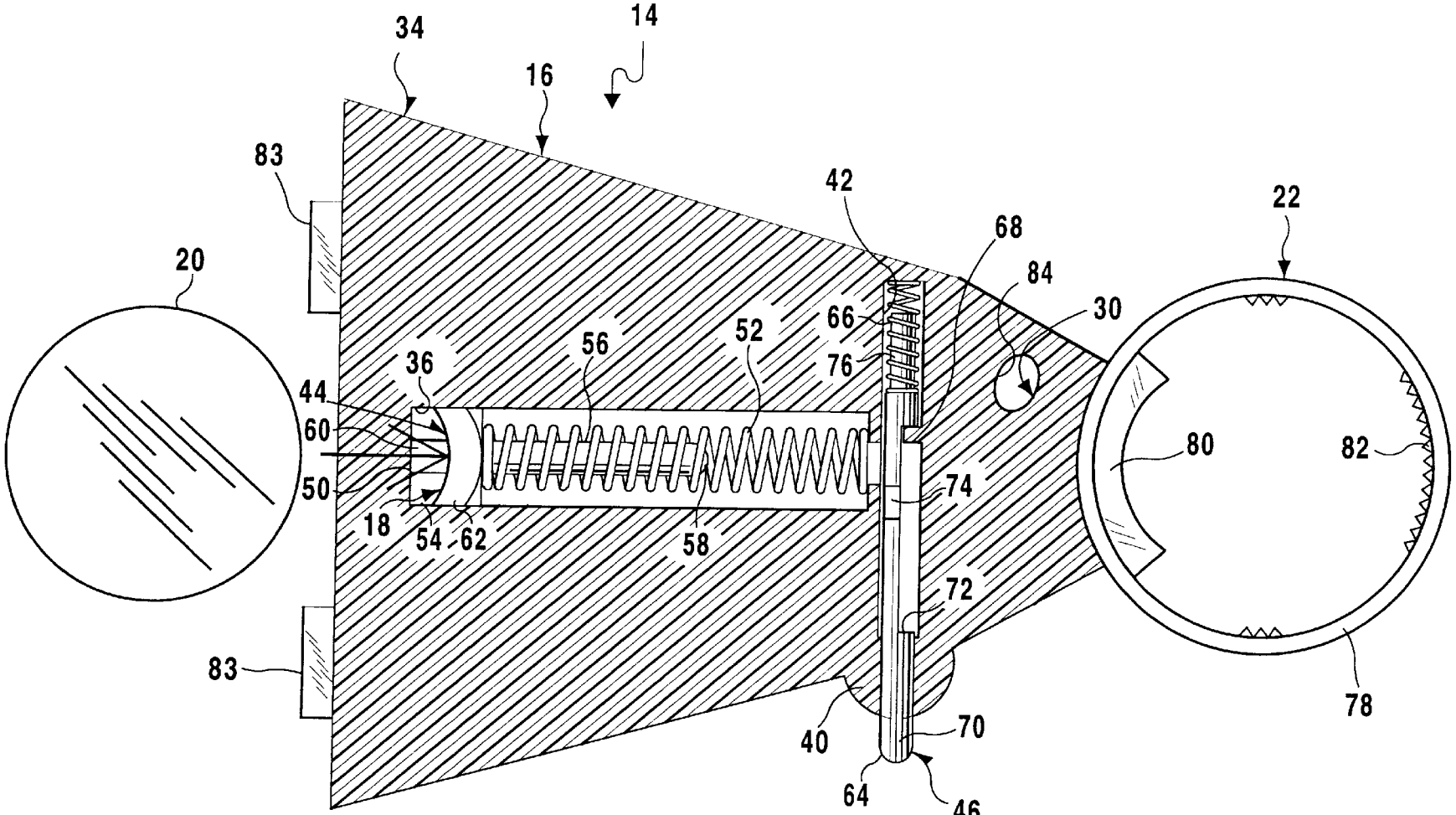
FIG. 2 is an enlarged cross sectional view taken along line 2—2 in FIG. 1, showing the bottle cap about to be pressed against the firing mechanism.
Figure 3:
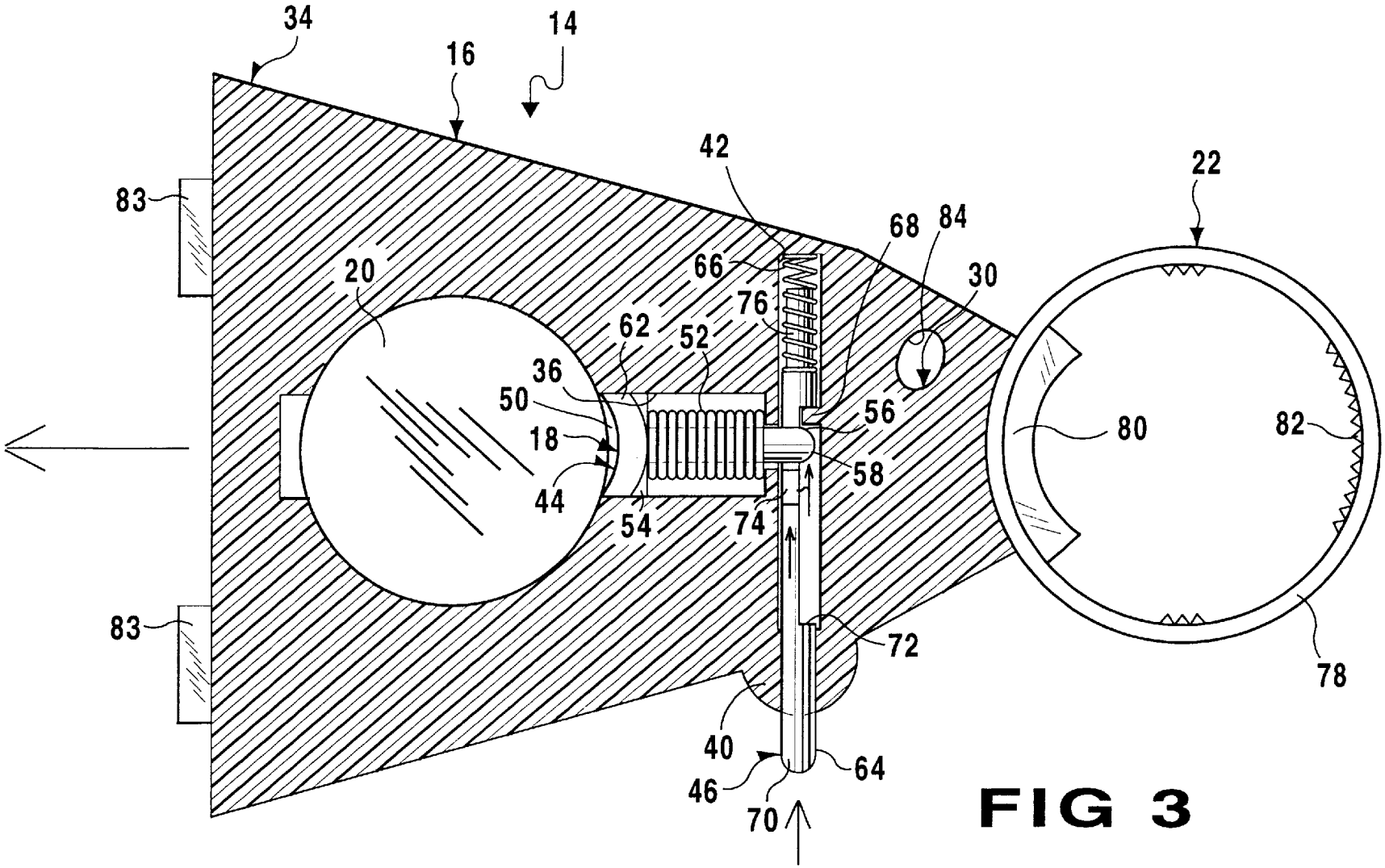
FIG. 3 is an enlarged cross sectional view similar to FIG. 2 taken along line 3—3 in FIG. 1, showing the bottle cap in its fully seated position against the firing mechanism.

Turning now descriptively to the drawings, in which similar reference characters denote similar elements throughout the several views, FIGS. 1 through 12 illustrate the present invention being a multipurpose bottle cap launcher 14. With regard to the reference numerals used, the following numbering is used throughout the various drawing figures.

14 multipurpose bottle cap launcher
16 body member of 14
18 shooting assembly of 14
20 bottle cap
22 bottle cap removing structure of 14 in 16
24 bottle
26 hand of 28
28 person
30 key holding facility of 14 in 16
32 key
34 flat triangular shaped frame for 16
36 central longitudinal slot in 38
38 top surface of 34
39 small wedge on 38
40 finger engagement projection on 34
42 transverse bore in 34
44 firing mechanism of 18
46 trigger mechanism of 18
48 finger of 26
50 propulsion unit of 44
52 spring of 44
54 block portion of 50
56 shaft portion of 50
58 hooked end on 56
60 neck portion of 50
62 curved engagement portion of 50
64 finger contact unit of 46
66 spring of 46
68 stop in 42
70 handle portion of 64

72 flat side cutout area in 70

74 top notch in 70

76 reduced shank portion of 64

78 collar of 22

80 curved flange in 78 of 22

82 serrations in 78 of 22

83 small protrusion of 22 on 16

84 small aperture in 16 for 30

86 key ring in 84

88 area on bottom surface of 16

The multipurpose bottle cap launcher 14 comprises a body member 16. An assembly 18 in the body member 16 is for shooting a bottle cap 20 therefrom for recreational target practice. A structure 22 in the body member 16 is for removing a bottle cap 20 from a bottle 24, which can be held and manipulated by a hand 26 of a person 28. A facility 30 in the body member 16 is for holding at least one key 32 thereon, to prevent loss of the at least one key 32, so that it can be used by the person 28 to unlock locks.

The body member 16 is a flat triangular shaped frame 34 having a central longitudinal slot 36 in a top surface 38. A pair of small wedges 39 are spaced apart and formed on the top surface 38, to position the bottle cap 20 in place for shooting. A finger engagement projection 40 is located on one opposite side. A transverse bore 42 adjacent an inner end of the central longitudinal slot 36 extends through the finger engagement projections 40.

The shooting assembly 18 includes a firing mechanism 44 carried within the central longitudinal slot 36 in the flat triangular shaped frame 34 to engage with the bottle cap 20. A trigger mechanism 46 extends out from the transverse bore 42 in the flat triangular shaped frame 34, for holding the firing mechanism 44 in a retracted position within the central longitudinal slot 36. When a finger 48 of the hand 26 of the person 28 grasping the flat triangular shaped frame 4 depresses the trigger mechanism 46, the firing mechanism 44 will be released to shoot the bottle cap 20 away from the flat triangular shaped frame 34.

The firing mechanism 44 consists of a propulsion unit 50 and a spring 52 in the central longitudinal slot 36 in the flat triangular shaped frame 34, to normally bias the propulsion unit 50 in a forward direction. The propulsion unit 50 includes a block portion 54, to ride within the central longitudinal slot 36 in the flat triangular shaped frame 34. A shaft portion 56 having a hooked end 58 extends rearwardly from the block portion 54. A neck portion 60 extends upwardly from the block portion 54. A curved engagement portion 62 on the neck portion 60 makes contact with the bottle cap 20.

The trigger mechanism 46 consists of a finger contact unit 64 and a spring 66 in the transverse bore 42 in the flat triangular shaped frame 34, to normally bias the finger contact unit 64 in a sidewards direction against a stop 68 in the transverse bore 42 and to partially extend out of the finger engagement projection 40.

The finger contact unit 64 includes a handle portion 70 having a flat side cutout area 72 to retain the hooked end 58 of the shaft portion 56 of the propulsion unit 50, while sliding past the stop 68 therein and a top notch 74 to release the hooked end 58 of the shaft portion 56 of the propulsion unit 50. A reduced shank portion 76 extends rearwardly from the handle portion 70, so as to engage with the spring 66 of the trigger mechanism 46.

The bottle cap removing structure 22 consists of a collar 78 affixed to a back end of the body member 16. A curved flange 80 is affixed to an inner surface of the collar 78, for lifting the bottle cap 20 off of a neck of the bottle 24. A plurality of serrations 82 are formed on the inner surface of the collar 78, to better grip the bottle cap 20. The bottle cap removing structure 22 also comprises a pair of spaced apart small protrusions 83 extending from a front end of the body member 16, for twisting the bottle cap 20 off of a neck of the bottle 24.

Figure 4:
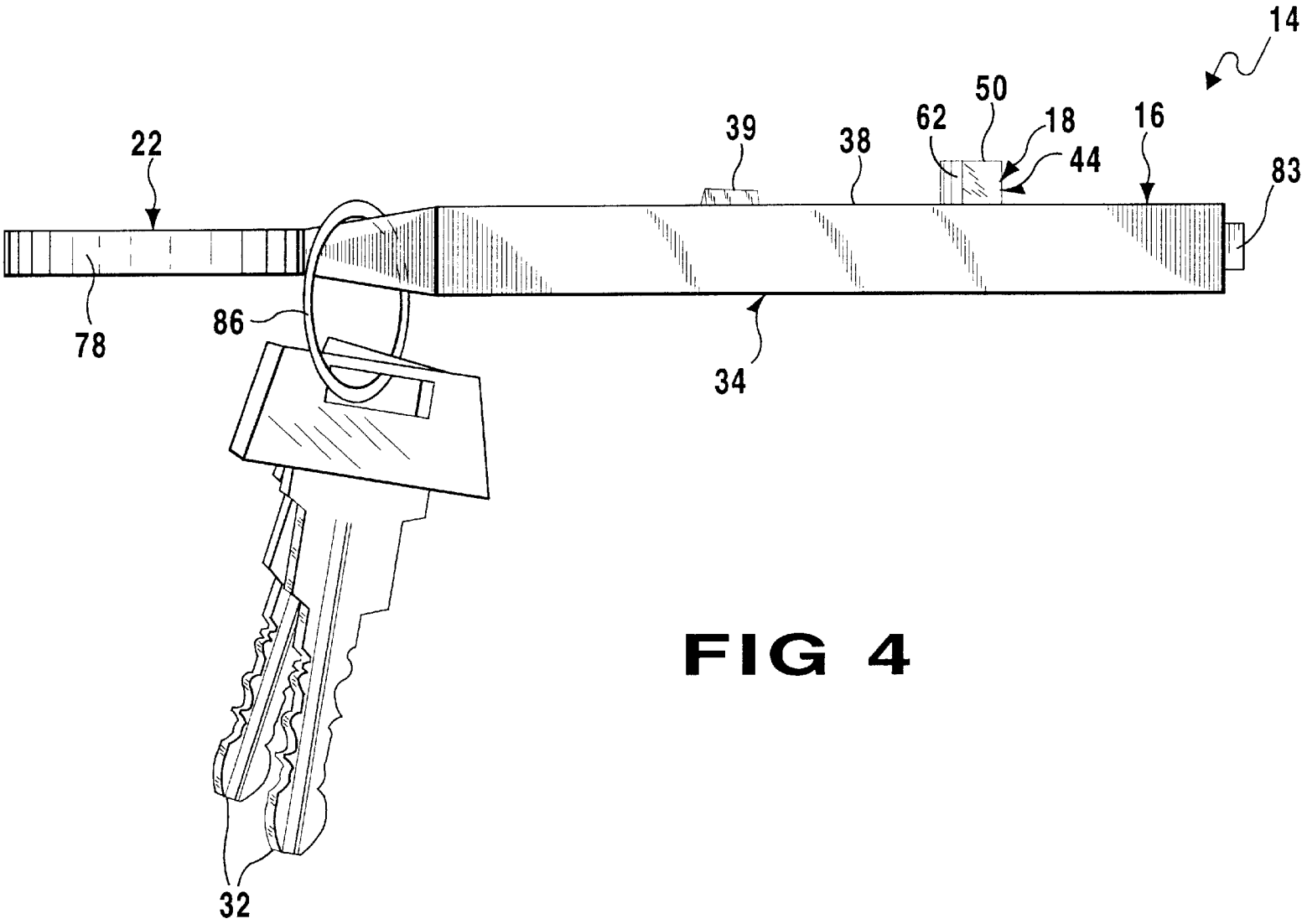
FIG. 4 is an enlarged side view taken in the direction of arrow 4 in FIG. 1, showing a key ring with keys installed thereto.
Figure 5:
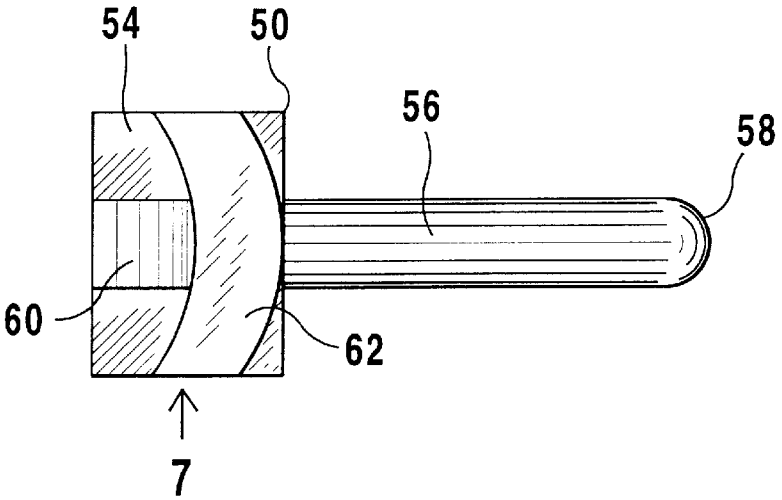
FIG. 5 is an enlarged top view of the propulsion unit of the firing mechanism taken in the direction of arrow 5 in FIG. 1.
Figure 6:
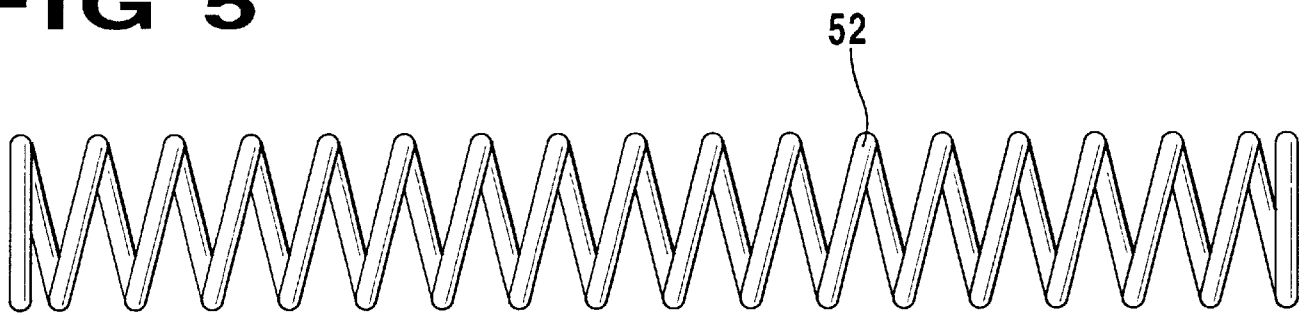
FIG. 6 is an enlarged elevational view of the firing mechanism spring.
Figure 7:
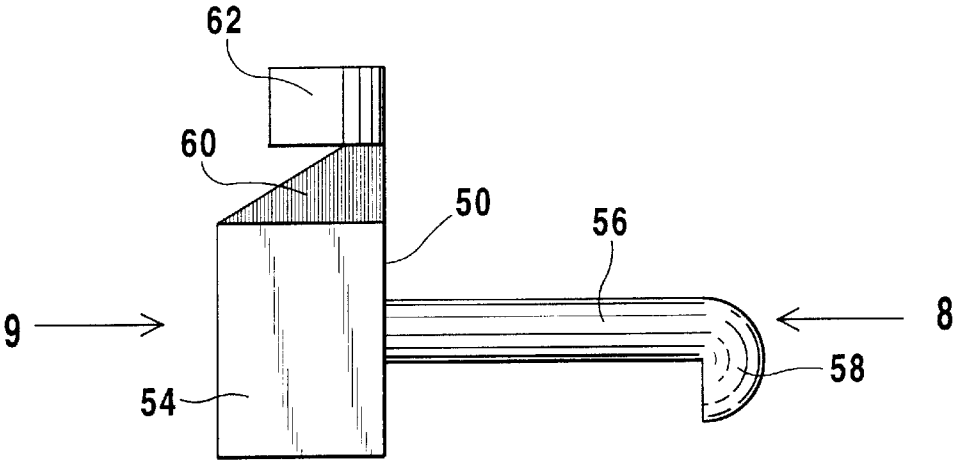
FIG. 7 is a side view taken in the direction of arrow 7 in FIG. 5.
Figure 9:
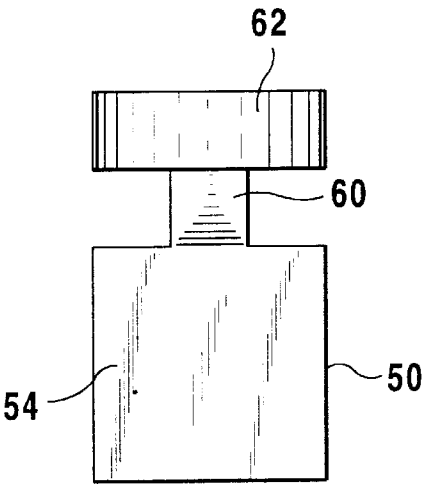
FIG. 9 is a front view taken in the direction of arrow 9 in FIG. 7.
Figure 8:
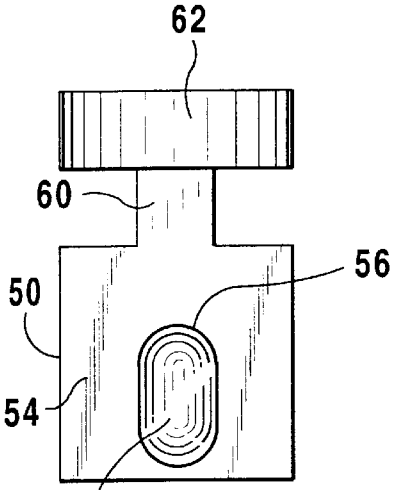
FIG. 8 is a rear view taken in the direction of arrow 8 in FIG. 7.
Figure 10:
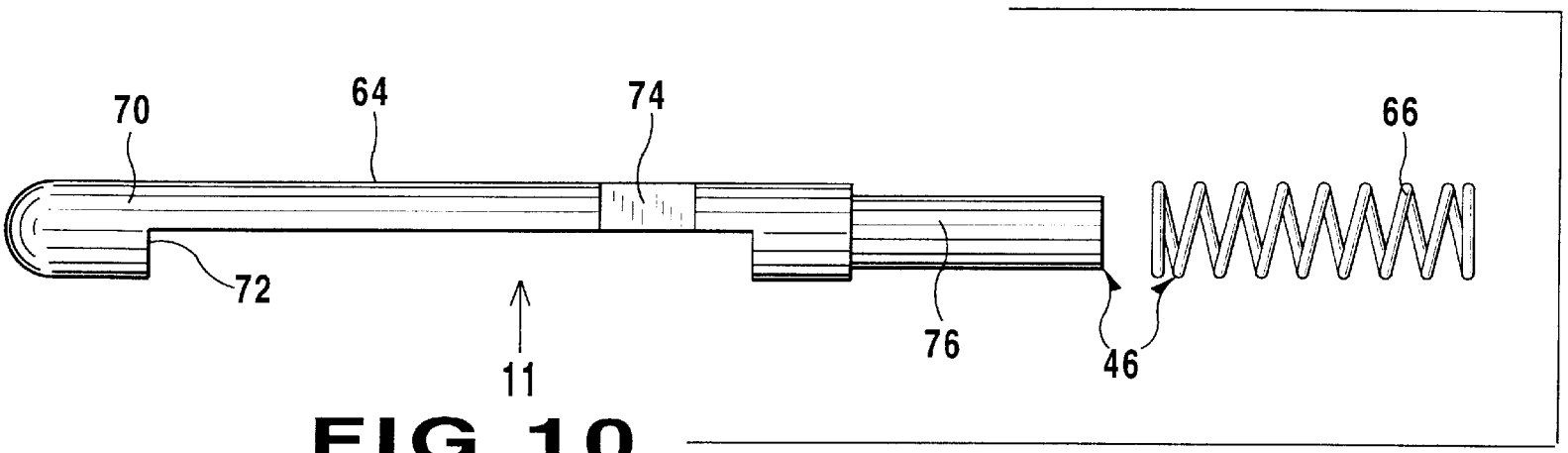
FIG. 10 is an enlarged top view of the trigger mechanism.
Figure 11:
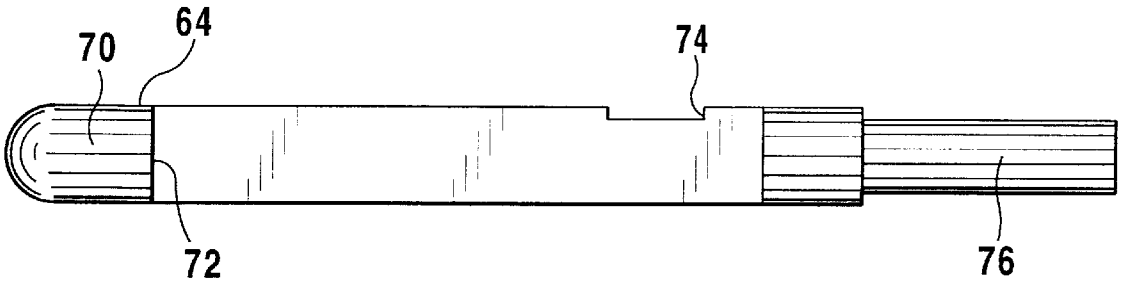
FIG. 11 is a side view taken in the direction of arrow 11 in FIG. 10, of the finger engagement unit of the trigger mechanism.
Figure 12:
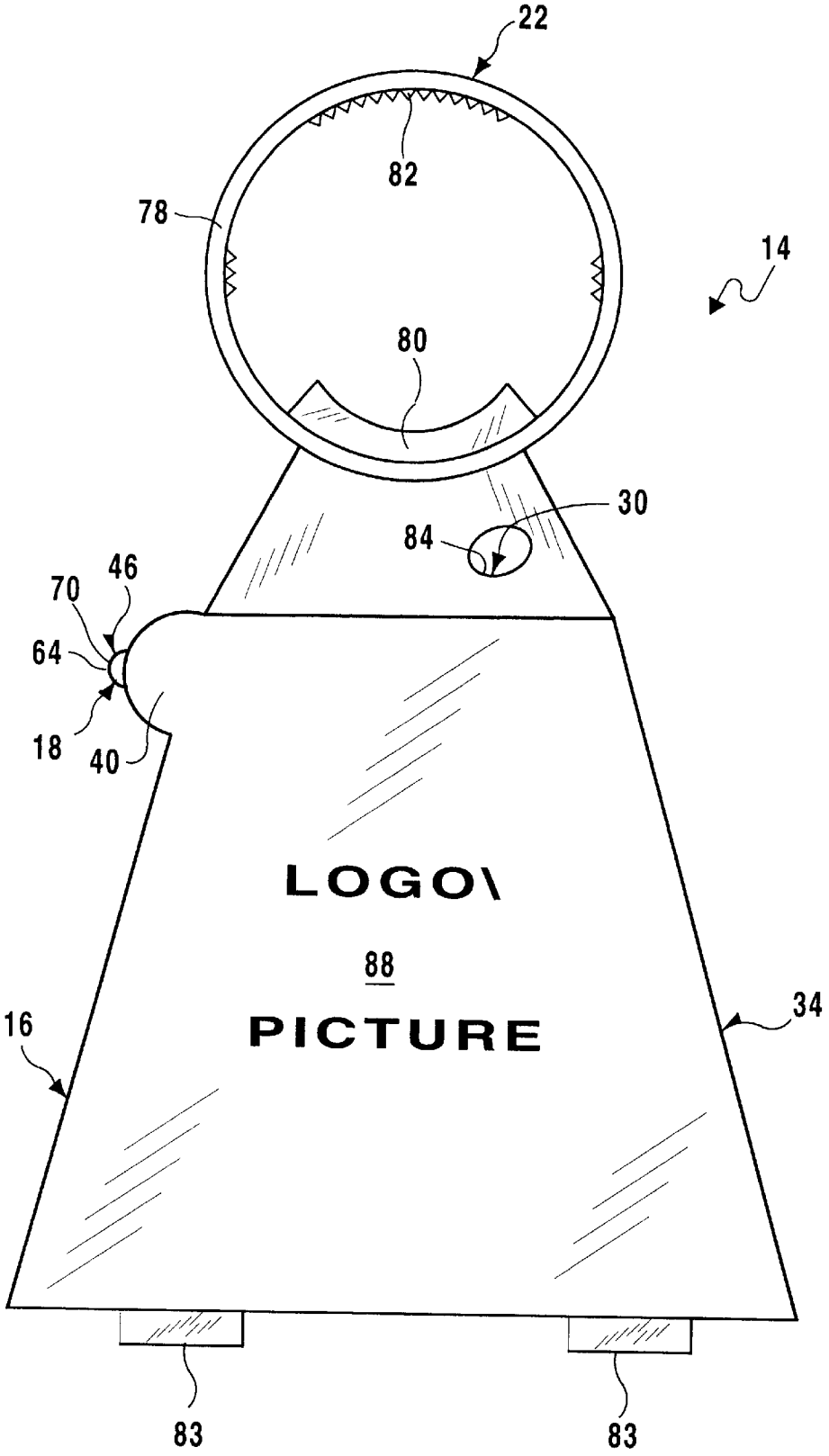
FIG. 12 is a bottom view of the present invention taken in the direction of arrow 12 in FIG. 1, showing a place on the body member for a logo or picture.

The key holding facility 30 includes the body member 16 having a small aperture 84 therethrough to receive a key ring 86 with the at least one key 32 thereon, as shown in FIG. 4. The body member 16 further contains an area 88 upon a bottom surface for placing a logo or picture thereupon, as shown in FIG. 12. It should also be noted that the firing mechanism 44 can be designed into other shapes, such as a head of an animal, without changing the intent of the present invention.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multipurpose bottle cap launcher comprising:

a) a body member;

b) means in said body member for shooting a bottle cap therefrom for recreational target practice;

c) means in said body member for removing a bottle cap from a bottle, which can be held and manipulated by a hand of a person; and d) means in said body member for holding at least one key thereon, to prevent loss of the at least one key, so that it can be used by the person to unlock locks.

2. A multipurpose bottle cap launcher as recited in claim 1, wherein said body member is an flat triangular shaped frame having a central longitudinal slot in a top surface, a pair of small wedges spaced apart and formed on the top surface to position the bottle cap in place for shooting, a finger engagement projection located on one side and a transverse bore adjacent an inner end of said central longitudinal slot which extends through said finger engagement projection.

3. A multipurpose bottle cap launcher as recited in claim 2, wherein said shooting means includes:

a) a firing mechanism carried within said central longitudinal slot in said flat triangular shaped frame to engage with the bottle cap; and b) a trigger mechanism extends out from said transverse bore in said flat triangular shaped frame, for holding said firing mechanism in a retracted position within said central longitudinal slot, so that when a finger of the hand of the person grasping said flat triangular shaped frame depresses said trigger mechanism, said firing mechanism will be released to shoot the bottle cap away from said flat triangular shaped frame.

4. A multipurpose bottle cap launcher as recited in claim 3, wherein said firing mechanism includes:

a) a propulsion unit; and b) a spring in said central longitudinal slot in said flat triangular shaped frame to normally bias said propulsion unit in a forward direction.

5. A multipurpose bottle cap launcher as recited in claim 4, wherein said propulsion unit includes:

a) a block portion to ride within said central longitudinal slot in said flat triangular shaped frame;

b) a shaft portion having a hooked end extending rearwardly from said block portion;

c) a neck portion extending upwardly from said block portion; and d) a curved engagement portion on said neck portion to make contact with the bottle cap.

6. A multipurpose bottle cap launcher as recited in claim 5, wherein said trigger mechanism includes:

a) a finger contact unit; and b) a spring in said transverse bore in said flat triangular shaped frame to normally bias said finger contact unit in a sidewards direction against a stop in said transverse bore and to partially extend out of said finger engagement projection.

7. A multipurpose bottle cap launcher as recited in claim 6, wherein said finger contact unit includes:

a) a handle portion having a flat side cutout area to retain said hooked end of said shaft portion of said propulsion unit, while sliding past said stop therein and a top notch to release said hooked end of said shaft portion of said propulsion unit; and b) a reduced shank portion extending rearwardly from said handle portion, so as to engage with said spring of said trigger mechanism.

8. A multipurpose bottle cap launcher as recited in claim 1, wherein said bottle cap removing means includes:

a) a collar affixed to a back end of said body member;

b) a curved flange affixed to an inner surface of said collar for lifting the bottle cap off of a neck of the bottle; and c) a plurality of serrations formed on said inner surface of said collar to better grip the bottle cap.

9. A multipurpose bottle cap launcher as recited in claim 1, wherein said bottle cap removing means includes a pair of spaced apart small protrusions extending from a front end of said body member for twisting the bottle cap off of a neck of the bottle.

10. A multipurpose bottle cap launcher as recited in claim 1, wherein said key holding means includes said body member having a small aperture therethrough to receive a key ring with the at least one key thereon.

11. A multipurpose bottle cap launcher as recited in claim 1, wherein said body member further includes an area upon a bottom surface for placing a logo or picture thereupon.

12. A multipurpose bottle cap launcher comprising:

a) a body member, wherein said body member is a flat triangular shaped frame having a central longitudinal slot in a top surface, a pair of small wedges spaced apart and formed on the top surface to position the bottle cap in place for shooting, a finger engagement projections located on one side and a transverse bore adjacent an inner end of said central longitudinal slot which extends through said finger engagement projection;

b) means in said body member for shooting a bottle cap therefrom for recreational target practice;

c) means in said body member for removing a bottle cap from a bottle, which can be held and manipulated by a hand of a person; and d) means in said body member for holding at least one key thereon, to prevent loss of the at least one key, so that it can be used by the person to unlock locks.

13. A multipurpose bottle cap launcher as recited in claim 12, wherein said shooting means includes:

a) a firing mechanism carried within said central longitudinal slot in said flat triangular shaped frame to engage with the bottle cap; and b) a trigger mechanism extends out from said transverse bore in said flat triangular shaped frame, for holding said firing mechanism in a retracted position within said central longitudinal slot, so that when a finger of the hand of the person grasping said flat triangular shaped frame depresses said trigger mechanism, said firing mechanism will be released to shoot the bottle cap away from said flat triangular shaped frame.

14. A multipurpose bottle cap launcher as recited in claim 13, wherein said firing mechanism includes:

a) a propulsion unit; and b) a spring in said central longitudinal slot in said flat triangular shaped frame to normally bias said propulsion unit in a forward direction.

15. A multipurpose bottle cap launcher as recited in claim 14, wherein said propulsion unit includes:

a) a block portion to ride within said central longitudinal slot in said flat triangular shaped frame;

b) a shaft portion having a hooked end extending rearwardly from said block portion;

c) a neck portion extending upwardly from said block portion; and d) a curved engagement portion on said neck portion to make contact with the bottle cap.

16. A multipurpose bottle cap launcher as recited in claim 15, wherein said trigger mechanism includes:

a) a finger contact unit; and b) a spring in said transverse bore in said flat triangular shaped frame to normally bias said finger contact unit in a sidewards direction against a stop in said transverse bore and to partially extend out of said finger engagement projection.

17. A multipurpose bottle cap launcher as recited in claim 16, wherein said finger contact unit includes:

a) a handle portion having a flat side cutout area to retain said hooked end of said shaft portion of said propulsion unit, while sliding past said stop therein and a top notch to release said hooked end of said shaft portion of said propulsion unit; and b) a reduced shank portion extending rearwardly from said handle portion, so as to engage with said spring of said trigger mechanism.

18. A multipurpose bottle cap launcher as recited in claim 17, wherein said bottle cap removing means includes:

a) a collar affixed to a back end of said body member;

b) a curved flange affixed to an inner surface of said collar for lifting the bottle cap off of a neck of the bottle; and c) a plurality of serrations formed on said inner surface of said collar to better grip the bottle cap.

19. A multipurpose bottle cap launcher as recited in claim 18, wherein said bottle cap removing means includes a pair of spaced apart small protrusions extending from a front end of said body member, for twisting the bottle cap off of a neck of the bottle.

20. A multipurpose bottle cap launcher as recited in claim 19, wherein said key holding means includes said body member having a small aperture therethrough to receive a key ring with the at least one key thereon.

21. A multipurpose bottle cap launcher as recited in claim 20, wherein said body member further includes an area upon a bottom surface for placing a logo or picture thereupon.

* * * * *